US005114434A

United States Patent [19]

Praulus et al.

[11] Patent Number: 5,114,434

[45] Date of Patent: * May 19, 1992

[54] VISCOREDUCED DIESEL FUELS HAVING IMPROVED CETANE NUMBERS

[75] Inventors: Michele Praulus, Saint-Cyr-au-Mont-d'Or; Bernard Dubreux, Francheville-le-Bas; Philippe Mulard, Saint-Pierre-de-Chandieu, all of France

[73] Assignee: Atochem, Puteaux, France

[ * ] Notice: The portion of the term of this patent subsequent to May 19, 2009 has been disclaimed.

[21] Appl. No.: 475,348

[22] Filed: Feb. 5, 1990

[30] Foreign Application Priority Data

Feb. 8, 1989 [FR] France ..... 89 01657

[51] Int. Cl.[5] ..... C10L 5/00; C10L 1/04

[52] U.S. Cl. ..... 44/322; 208/15; 585/14; 44/385

[58] Field of Search ..... 44/57, 70, 77, 322, 44/385; 208/15

[56] References Cited

U.S. PATENT DOCUMENTS

| | | | |
|---|---|---|---|
| 1,972,102 | 9/1934 | Malisoff | 208/219 |
| 2,092,322 | 9/1937 | Rudolf | 44/57 |
| 2,093,008 | 9/1937 | Egerton | 44/57 |
| 2,296,558 | 9/1942 | Kokatnur | 44/57 |
| 2,403,771 | 7/1946 | Vaughan | 44/57 |
| 2,403,772 | 7/1946 | Vaughan | 44/57 |
| 2,472,152 | 6/1949 | Farkas | 44/57 |
| 2,481,859 | 9/1949 | Miller | 44/57 |
| 2,912,313 | 11/1959 | Hinkamp | 44/57 |
| 3,035,904 | 5/1962 | Brown | 44/57 |
| 3,719,589 | 3/1973 | Herbstman et al. | 208/208 R |
| 3,827,979 | 8/1974 | Piotrowski et al. | 44/57 |
| 4,248,182 | 2/1981 | Malec | 44/57 |
| 4,286,964 | 9/1981 | Medcalf | 44/57 |
| 4,289,501 | 9/1981 | Medcalf | 44/57 |
| 4,406,254 | 9/1983 | Harris et al. | 44/57 |
| 4,474,574 | 10/1984 | Wilderson et al. | 44/57 |
| 4,482,352 | 11/1984 | Osgood et al. | 44/57 |

FOREIGN PATENT DOCUMENTS

| | | |
|---|---|---|
| 0237214 | 9/1987 | European Pat. Off. . |
| 0252606 | 1/1988 | European Pat. Off. . |

*Primary Examiner*—Helane E. Myers

*Attorney, Agent, or Firm*—Burns, Doane, Swecker & Mathis

[57] ABSTRACT

The cetane numbers of viscoreduced diesel fuels are significantly improved by intimately contacting same with an effective amount of hydrogen peroxide in the presence of a carboxylic acid, or with an effective amount of a percarboxylic acid either in the presence or absence of hydrogen peroxide; the final product diesel fuels are also effectively deodorized and decolorized.

13 Claims, No Drawings

VISCOREDUCED DIESEL FUELS HAVING IMPROVED CETANE NUMBERS

BACKGROUND OF THE INVENTION

1. Field of the Invention

The present invention relates to a process for improving the cetane number or index of viscoreduced diesel fuels and to such diesel fuels, per se, having improved cetane numbers.

2. Description of the Prior Art

Diesel fuels proper are median distillates, intermediate between light distillates, gas and gasolines and heavier products, produced by distillation at atmospheric pressure, at which the refining of crude oils begins. Diesel fuels are essentially intended for use as fuels for diesel engines and for domestic heating.

The diesel fuels, which are thus derived directly from crude oils, or direct diesel oils, must have a sufficiently high compression ignition rating, expressed by their cetane number, which is comparable to the octane number rating for gasoline.

The desirability of having available to industry such diesel fuels having a high cetane number has been recently described, for example in the European patent published under No. 0,252,606. Presently, cetane numbers higher than about 45, preferably higher than 50, are considered desirable.

One proposed solution to ensure a satisfactory cetane number for direct diesel fuels entails incorporating an additive therein. The disadvantage of such a technique is that the selection of the additive is restricted to one that is simultaneously relatively insoluble in water and chemically stable relative thereto, sufficiently soluble in the diesel fuel under the preferred conditions of use, stable in diesel fuel at all storage temperatures, and finally, noncorrosive and nontoxic.

The distillation in a vacuum of products heavier than diesel fuel, or atmospheric residue, in turn yields a heavy residue or vacuum residue, which is then subjected to a viscosity reducing operation.

This operation, also designated "visbreaking", is a thermal cracking process, which reduces, at its name implies, the viscosity of the petroleum product to which it is applied. It is essentially different in its nature, for example from catalytic cracking, to which such petroleum product may also be subjected. It yields a product, designated a viscoreduction diesel fuel, which itself is essentially different from a direct diesel fuel or the diesel fuel emanating from catalytic cracking.

Viscoreduced diesel fuels cannot be used as such either as motor fuels or for domestic heating, in view of their excessively low cetane number, which is not sufficiently improved by the additives suitable for the direct diesel fuels.

For a definition of the terms employed herein, such as motor diesel fuel, cetane number, etc., reference may be made to the following texts: *Le langage petrolier* (The language of petroleum), Gauthier-Villars, Paris (1964); *Le Petrole, raffinage et genie chimique* (Petroleum, refining and chemical engineering), edited by Pierre Wuithier, 2nd edition, Technip Publisher, pp. 16, 17, 29, 30 (1972), or the article by D. Indritz, "Preprints, Symposium of the Chemistry of Cetane Number Improvement", Miami Beach, Apr. 28–May 3, 1985, pp. 282–286.

SUMMARY OF THE INVENTION

Accordingly, a major object of the present invention is the provision of improved viscoreduction diesel fuels having such enhanced cetane numbers that they can be directly used in those fields of application typically reserved for the "direct" diesel fuels.

Briefly, the present invention features improving the cetane number of viscoreduction diesel fuels by intimately contacting same with hydrogen peroxide in the presence of a carboxylic acid, or with a percarboxylic acid in the presence or absence of hydrogen peroxide.

DETAILED DESCRIPTION OF THE PREFERRED EMBODIMENTS OF THE INVENTION

More particularly according to the present invention, in the embodiment wherein the viscoreduction diesel fuel is intimately contacted with hydrogen peroxide in the presence of a carboxylic acid:

(i) the amount of hydrogen peroxide used per kg of the viscoreduction diesel fuel, for reasons of safety and economy, is advantageously less than 300 g. It typically is at least about 10 g and preferably ranges from 25 g to 100 g;

(ii) the carboxylic acid, in actual practice, is advantageously selected from among formic acid, acetic acid and propionic acid; formic acid is the preferred. The molar ratio carboxylic acid/hydrogen peroxide preferably ranges from about 0.01 to 1, and even more preferably ranges from about 0.1 to 0.5;

(iii) the temperature at which the intimate contacting of the invention is carried out advantageously ranges from about 50° to 100° C.;

(iv) the hydrogen peroxide may be employed in the form of an aqueous solution, containing, for example and most typically, from approximately 50% to 70% by weight of hydrogen peroxide;

(v) the duration of the contact time according to the invention depends on the other process parameters selected; preferably, it is sufficient, in combination with the other process parameters, to ensure the substantially complete disappearance or consumption of the hydrogen peroxide used, for example the disappearance of more than 95% or even more than 98% to 99% of said hydrogen peroxide; and (vi) the intimate contacting is carried out under agitation in a reactor resistant to acid corrosion and essentially equipped with an efficient agitator system, heating means and means to measure and control the temperature.

In the embodiment in which the viscoreduction diesel fuel is intimately contacted with a percarboxylic acid:

(i) the percarboxylic acid is advantageously selected, in actual practice, from among performic acid, peracetic acid and perpropionic acid. These are prepared in known manner, for example, relative to perpropionic acid, according to the processes described in the French applications published under Nos. 2,460,927, 2,464,947 and 2,519,634, respectively;

(ii) if the percarboxylic acid is used in the absence of hydrogen peroxide, it is employed in the same molar quantities as the hydrogen peroxide in the first embodiment described above; and (iii) if the percarboxylic acid is used in the presence of hydrogen peroxide, the cumulative molar quantities of the percarboxylic acid and the hydrogen peroxide are the same as those of the hydrogen peroxide used in the first embodiment of the invention.

The process according to the invention makes possible not only a substantial increase in the cetane number of viscoreduction diesel fuels processed thereby, but also effects a deodorization and decoloration thereof.

In order to further illustrate the present invention and the advantages thereof, the following specific examples are given, it being understood that same are intended only as illustrative and in nowise limitative:

EXAMPLE 1:

Into an agitated 3 liter reactor, 1,000 g viscoreduction diesel fuel and then 0.195 mole of formic acid were introduced. The agitated mixture was heated to 70° C. and was maintained at this temperature under agitation, first during the addition over 1 hour and under agitation of 1.85 mole of hydrogen peroxide, used in the form of 90 g of an aqueous solution containing 70% by weight hydrogen peroxide, and then for 5 hours beginning from the point in time of completion of the addition of the hydrogen peroxide.

The organic phase, separated subsequently by decantation of the mixture, was permitted to rest and cool, and was then washed such that the hydrogen peroxide and formic acid, which may have remained in the diesel fuel after treatment, was eliminated. Water was used for the washing.

The cetane index of the starting material viscoreduction diesel fuel, measured according to the ASTM-D 613 standard, was equal to 39. That of the viscoreduction diesel fuel, after being subjected to the process according to the invention, was 50.

The diesel fuel after treatment by the process of the invention was strongly deodorized relative to the starting diesel fuel. It was also distinguished from the starting diesel fuel by a coloration, expressed by a HAZEN degree after dilution by a factor of 100 of the sample in acetone, that was 5 times weaker.

EXAMPLE 2

The operating process described in Example 1 was repeated with the same starting diesel fuel relative to its nature and quantity, but using 0.26 mole formic acid and 2.6 moles of hydrogen peroxide in the form of 126 g of an aqueous solution of 70% by weight of hydrogen peroxide.

The viscoreduction diesel fuel obtained by the process of the invention had a cetane index of 53.5, was strongly deodorized and 5 times less colored than initially.

EXAMPLE 3

The procedure of Example 1 was repeated, but replacing the formic acid with 0.13 mole acetic acid; a result similar to that obtained in Example 1 was achieved, but after a contact time of essentially twice that used in Example 1.

While the invention has been described in terms of various preferred embodiments, the skilled artisan will appreciate that various modifications, substitutions, omissions, and changes may be made without departing from the spirit thereof. Accordingly, it is intended that the scope of the present invention be limited solely by the scope of the following claims, including equivalents thereof.

What is claimed is:

1. A process for improving the cetane number of a viscoreduced diesel fuel, comprising intimately contacting said viscoreduced diesel fuel with an effective amount of hydrogen peroxide in the presence of formic acid, acetic acid or propionic acid, or with an effective amount of performic acid, peracetic acid or perpropionic acid either in the presence or absence of hydrogen peroxide.

2. The process as defined by claim 1, comprising intimately contacting said viscoreduced diesel fuel with an effective amount of hydrogen peroxide in the persence of formic acid, acetic acid or propionic acid.

3. The process as defined by claim 1, comprising intimately contacting said viscoreduced diesel fuel with an effective amount of performic acid, peracetic acid or perpropionic acid.

4. The process as defined by claim 3, comprising intimately contacting said viscoreduced diesel fuel with an effective amount of performic acid, peracetic acid or perpropionic acid in the presence of hydrogen peroxide.

5. The process as defined by claim 3, comprising intimately contacting said viscoreduced diesel fuel with an effective amount of performic acid, peracetic acid or perpropionic acid in the absence of hydrogen peroxide.

6. The process as defined by claim 2, wherein the effective amount of hydrogen peroxide is less than 300 g per kilogram of viscoreduced diesel fuel.

7. The process as defined by claim 6, wherein the effective amount of hydrogen peroxide is at least 10 g per kilogram of viscoreduced diesel fuel.

8. The process as defined by claim 7, wherein the effective amount of hydrogen peroxide ranges from 25 g to 100 g per kilogram of viscoreduced diesel fuel.

9. The process as defined by claim 2, wherein the molar ratio acid/hydrogen peroxide ranges from about 0.01 to 1.

10. The process as defined by claim 10, said molar ratio ranging from 0.3 to 0.5.

11. The process as defined by claim 1, carried out at a temperature ranging from 50° to 100° C.

12. The process as defined in claim 1, carried out for such extent as to assure essentially complete disappearance of the hydrogen peroxide and/or percarboxylic acid.

13. The process as defined by claim 2, said hydrogen peroxide comprising an aqueous solution thereof.

* * * * *